US005505066A

United States Patent [19]

Baucom

[11] Patent Number: 5,505,066

[45] Date of Patent: Apr. 9, 1996

[54] KEY SAFE APPARATUS

[75] Inventor: Larry H. Baucom, Mint Hill, N.C.

[73] Assignee: One Way Out, Inc., Mint Hill, N.C.

[21] Appl. No.: 242,469

[22] Filed: May 13, 1994

Related U.S. Application Data

[63] Continuation-in-part of Ser. No. 237,043, May 3, 1994, abandoned.

[51] Int. Cl.[6] ..... E05B 11/00

[52] U.S. Cl. ..... 70/389; 70/433; 70/434

[58] Field of Search ..... 70/388, 389, 61, 70/441, 429, 430, 432–434, 63; 211/4, 8, 9

[56] References Cited

U.S. PATENT DOCUMENTS

| | | | |
|---|---|---|---|
| 518,211 | 4/1894 | Johnson | 70/441 |
| 537,311 | 4/1895 | Schade | 70/411 |
| 882,303 | 3/1908 | Eighler | 70/389 |
| 2,064,474 | 12/1936 | Hopkins | 70/389 X |
| 2,220,786 | 11/1940 | Grainger | 70/262 |
| 2,336,936 | 12/1943 | Johnson | 70/61 |
| 2,396,759 | 3/1946 | Thieme | 70/265 |
| 2,568,206 | 9/1951 | Seaman et al. | 70/388 |
| 2,894,082 | 7/1959 | Collotta | 70/389 X |
| 3,095,558 | 6/1963 | Crudgington et al. | 70/389 X |
| 3,154,938 | 11/1964 | Cohen | 70/134 |
| 3,391,260 | 7/1968 | Messera | 70/388 X |
| 3,553,988 | 1/1971 | Fitzgerald | 70/433 |
| 3,774,227 | 11/1973 | Smilgys | 70/433 X |
| 4,472,952 | 9/1984 | Hollowell, Jr. | 70/61 |
| 4,559,796 | 12/1985 | DeForrest, Sr. | 70/434 |
| 4,567,741 | 2/1986 | Trempala | 70/389 |
| 4,591,852 | 5/1986 | Brod | 70/433 X |
| 4,641,509 | 2/1987 | Batchelor et al. | 70/388 |
| 4,753,092 | 6/1988 | Mercer | 70/389 |
| 5,020,347 | 6/1991 | Logan | 70/389 |
| 5,062,670 | 11/1991 | Grossman | 70/434 X |
| 5,372,021 | 12/1994 | Smith | 70/63 |

FOREIGN PATENT DOCUMENTS

| | | | |
|---|---|---|---|
| 2616944 | 12/1988 | France | 211/9 |
| 2213342 | 9/1973 | Germany . | |
| 1500003 | 2/1978 | United Kingdom | 70/389 |
| 8901673 | 2/1989 | WIPO | 70/433 |

*Primary Examiner*—Steven N. Meyers
*Assistant Examiner*—Suzanne L. Dino
*Attorney, Agent, or Firm*—Shefte, Pinckney & Sawyer

[57] ABSTRACT

An apparatus for alternately retaining a selected one of a pair of keys and releasing the other one of the pair of keys is provided. The retained key cannot be released until the other key is again disposed in a retained position. The apparatus includes a base plate having a pair of key receptacles, a slider assembly slidably mounted on the base plate, a visitor key having a pinion gear and a home key. The slider assembly includes a pair of key retaining slots for respectively retaining each key and a rack for driving engagement by the visitor key pinion gear for effecting sliding movement of the slider assembly in response to rotation of the visitor key pinion gear. A conventional key can be secured to the home key to control use of the conventional key through the selected release and retention of the visitor key and the home key.

15 Claims, 4 Drawing Sheets

KEY SAFE APPARATUS

CROSS-REFERENCE TO RELATED APPLICATION

This is a continuation-in-part of U.S. patent application Ser. No. 08/237,043, filed May 3, 1994, entitled KEY SAFE APPARATUS and now abandoned.

BACKGROUND OF THE INVENTION

The present invention relates to a key safe apparatus and, more particularly, to an apparatus for alternately retaining a selected one of a pair of keys upon the release of the other key until the other key is again disposed in a retained disposition.

In organizations having inventory items, such as automobiles or other vehicles, which are each individually accessed and/or operated by a dedicated key, there is an acute need to maintain the keys in an orderly and organized manner, preferably in a central location, so that members of the organization, such as sales people and the like, can reliably and readily locate a key to conduct test drives, offer product demonstrations and conduct other activities with the individually accessible inventory item. In this regard, experience has shown that the approach of merely providing a central keyboard or keybox in which the keys are collectively stored soon undermines the goal of maintaining the keys in a readily retrievable disposition. For example, several of the key users are invariably delinquent in returning the "borrowed" keys to the central keyboard or keybox. Likewise, the key users often find it convenient to borrow several keys at once, thereby depriving others of the opportunity to make use of the borrowed keys unless the multiple key borrower is identified and contacted to obtain the desired keys.

Accordingly, the need exists for an apparatus which ensures that a desired key will not be released to a potential key user unless some means of identification, such as the potential key user's own key, is automatically retained in response to the borrowing of the desired key. Additionally, the need exists for an apparatus for selectively releasing and retaining keys which only releases the key user's identification means, such as the user's own keys, upon disposition of the borrowed key in a key retained position.

One such apparatus which addresses these needs is disclosed in U.S. Pat. No. 5,020,347. The apparatus operates by alternately retaining a selected one of a pair of keys and releasing the other one of the pair of keys. The retained key cannot be released until the other key is again disposed in a retained position. The apparatus includes a base plate having a pair of key receptacles, a slider member slidably mounted on the base plate, a visitor key having a pinion gear and a home key. The slider member includes a pair of key retaining slots for respectively retaining each key and a rack for driving engagement by the visitor key pinion gear for effecting sliding movement of the slider member in response to rotation of the visitor key pinion gear. A conventional key can be secured to the home key to control use of the conventional key through the selected release and retention of the visitor key and the home key.

SUMMARY OF THE INVENTION

The present invention provides an improvement to the apparatus of U.S. Pat. No. 5,020,347.

Briefly described, the present invention provides a device for alternately locking a selected one of a pair of keys and releasing the other key for removal from the device. The device includes a home key normally locked in the device, a visitor key normally not locked in the device, lock base means defining a pair of key receptacles and locking means movable relative to the lock base means. Each key receptacle of the lock base means receives a respective one of the home and visitor keys. The locking means is movable between a first position locking the home key in its key receptacle and a second position releasing the home key for removal from its key receptacle. The locking means includes operating means, compatibly configured with the visitor key, for effecting movement of the locking means between its first and second positions in response to movement of the visitor key when received in its key receptacle and for locking the visitor key in its key receptacle in response to movement of the locking means into its second position.

According to one aspect of the present key safe apparatus, the locking means comprises a slider assembly which is movably mounted to the lock base means for reciprocating movement by the visitor key when received in its key receptacle, the slider assembly being arranged for executing a detectable movement away from the lock base means during a reciprocating movement of the slider assembly for removing the home key, which enables monitoring of each removal and replacement of the home key.

In the preferred embodiment, a cam arrangement is utilized to accomplish the detectable movement of the slider assembly. Specifically, the slider assembly preferably includes an arm portion having a profiled cam surface thereon for engagement with a bearing surface so as to move toward and away from the lock base means during reciprocating movements of the slider assembly. The arm portion of the slider assembly is disposed adjacent the visitor key receptacle so as to be deflected away from the lock base means upon insertion of the visitor key in its key receptacle. Therefore, if desired, appropriate means may be provided for detecting each such detectable movement of the arm portion of the slider assembly and storing the information derived concerning such detected movements.

In accordance with another aspect of the present invention, a projecting stop member and first and second stop recesses are formed on the lock base means at spacings from one another generally along the extent of reciprocating movement of the slider assembly. The slider assembly includes a resilient locking member having a pair of engagement elements resiliently movable toward and away from one another, a locking leg portion spaced from the engagement elements, and a connecting arm portion extending therebetween. The engagement elements and the locking leg portion of the locking member and the stop member and stop recesses on the lock base means are cooperatively arranged (a) for gripping engagement by the engagement elements in opposition to one another about the stop member and engagement of the locking leg portion in the first stop recess when the locking means is in its first position with the home key received in its key receptacle, thereby to prevent movement of the locking means to its second position without insertion of the visitor key into its key receptacle, and (b) for abutment of the engagement elements with a common side surface of the stop member and engagement of the locking leg portion in the second stop recess when the locking means is in its second position with the home key removed from its key receptacle, thereby to prevent movement of the locking means to its first position without return of the home key into its key receptacle.

Preferably, the connecting arm portion of the locking member is disposed adjacent the visitor key receptacle to be deflected away from the lock base means upon insertion of the visitor key in its key receptacle in order to displace the locking leg portion out of the first stop recess to enable movement of the locking means from the first position to the second position.

The engagement elements of the locking member preferably include cam portions for engagement with the home key when in its key receptacle to expand the engagement elements away from one another during movement of the slider assembly by the visitor key to disengage the engagement elements from the stop member for movement of the locking means between the first and second positions.

A ramp surface connects the first and second stop recesses for sliding movement of the locking leg portion from the second stop recess into the first stop recess during movement of the locking means from the second position into the first position.

According to the preferred embodiment of the device of the present invention, the home key includes a main body portion having a free insertion end and a portion, spaced from its free end, of reduced cross section, and the visitor key includes a main body portion having a free insertion end, a portion, spaced from its free end, of reduced cross section, and a gear portion. Additionally, the preferred embodiment includes a toothed rack secured to the slider assembly.

Preferably, the slider assembly includes a home key slot having a width less than the cross sectional extent of the main body portion of the home key yet greater than the cross sectional extent of the reduced cross section portion thereof, and a visitor key slot having a narrow portion of a width less than the cross sectional extent of the main body portion of the visitor key yet greater than the cross sectional extent of the reduced cross section portion thereof, the narrow portion of the visitor key slot being adapted for selectively engaging the visitor key at its reduced cross section portion in a fork-like manner. Also, the slide assembly includes an enlarged portion of the visitor key slot having a width greater than the cross sectional extent of the main body portion of the visitor key.

According to a further aspect of the present invention, the device is additionally provided with a means for covering a portion of the blocking means adjacent the visitor key receptacle from access thereto through the visitor key receptacle in the first position of the locking means, thereby preventing unauthorized circumvention of the locking means. In particular, the covering means preferably comprises a cover element disposed stationarily between the visitor key receptacle and an arm of the slider assembly of the locking means, the cover element including a slot which slidably receives the arm during movement of the slider assembly between the first and second positions of the locking means.

DETAILED DESCRIPTION OF THE PREFERRED EMBODIMENT

Figure 1:
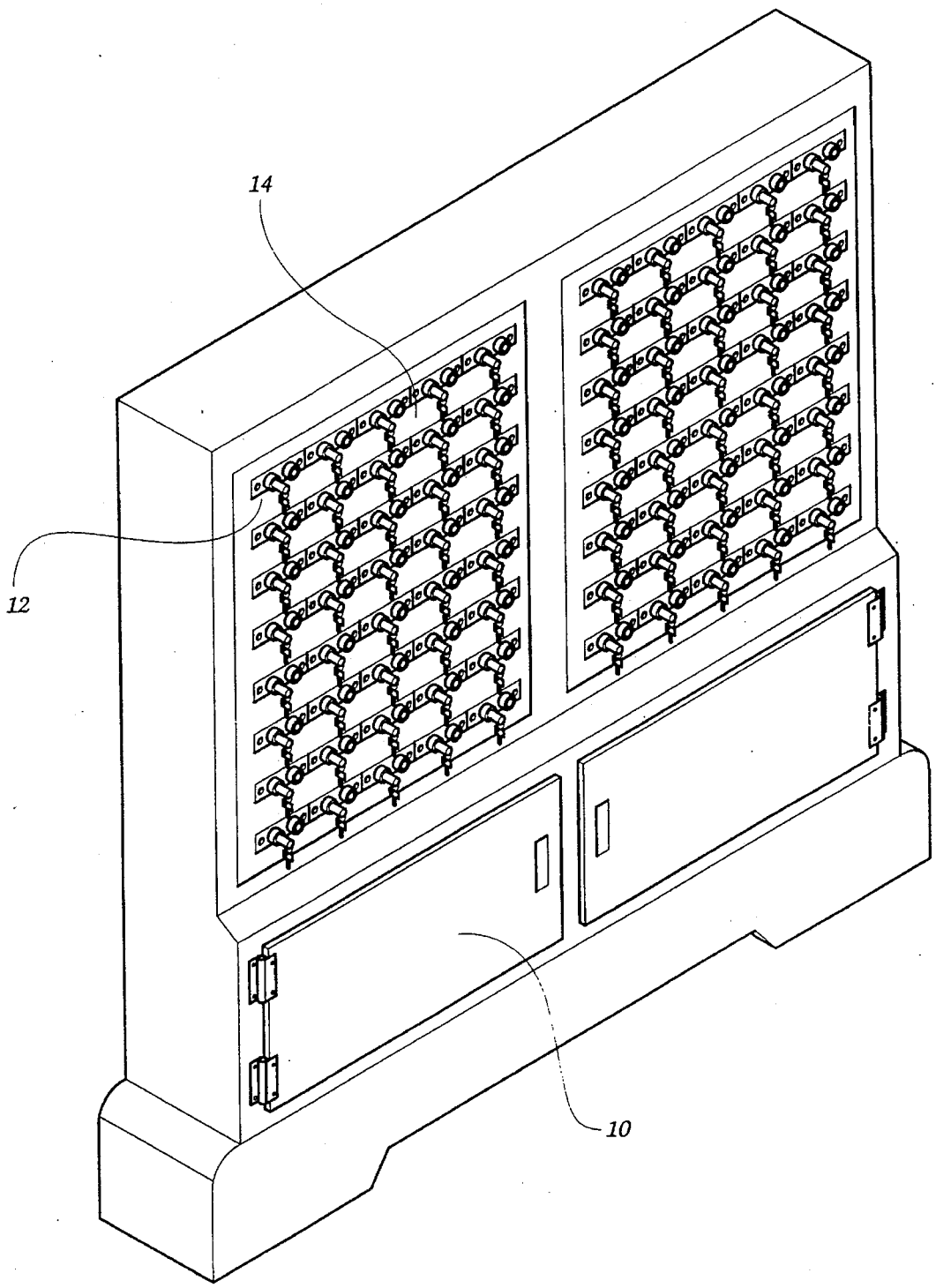
FIG. 1 is a perspective view of a cabinet supporting a plurality of identical units of one preferred embodiment of the key safe apparatus of the present invention.

In FIG. 1, a cabinet 10 is illustrated which supports a plurality of identical units of the preferred embodiment of the key safe apparatus of the present invention and a representative unit of the apparatus is generally designated as 12. The identical units of the key safe apparatus 12 are arranged in horizontal rows and vertical columns with one another with the outer faces 14 thereof commonly forming a generally planar cabinet face.

With reference now to FIGS. 2–6, the structure and operation of each unit of the key safe apparatus of the present invention will be described in further detail with respect to the key safe apparatus unit 12 in the upper left-hand corner of the cabinet 10, it being understood that the other key safe apparatus units are similarly configured and operated. The key safe apparatus 12 basically includes a lock base means, such as a base plate 16 which forms the outer face 14 of the unit 12, a locking means, such as a slider assembly 18, a home key 20 and a visitor key 22. The home key 20 typically has attached thereto an item to which ready access must be available but which also needs security control of access, e.g., a conventional key 24 secured thereto by a conventional key loop 25. In accordance with the present invention, the key safe apparatus 12 provides a means for controlling access to the conventional key 24 through selected release and retention of the home key 20 caused by the interrelated operations of the slider assembly 18 with respect to the home key 20 and the visitor key 22. The conventional key 24 can be, for example, a key uniquely configured to lock and unlock an inventory item, such as an automobile. As will be described in more detail, each person who is authorized to gain access to any particular one of the conventional keys 24 is provided with one copy of the visitor key 22. The key safe apparatus 12 is adapted to alternately lock a selected one of the home key 20 and the visitor key 22 while simultaneously releasing the other key, whereby a person desiring to borrow a particular one of the conventional keys 24 must forfeit possession of his or her visitor key 22 until the home key 20 to which the particular conventional key 24 is secured is again returned to, and retained by, the cabinet 10.

The base plate 16 is a generally rigid, entry-resistant structure, such as, for example, a rectangular metal or high impact plastic plate, which is secured to a frame of the cabinet 10 in flush relation with the base plates 16 of other units 12 in the cabinet by any appropriate securement means, e.g., by fasteners (not shown) extending through mounting bores 23 in the base plate 16. The base plate 16 defines a pair of key receptacles 26,28, the key receptacle 26 being adapted for receiving the home key 20 and the key receptacle 28 being adapted for receiving the visitor key 22. The key receptacles 26,28 are cylindrical hubs which project outwardly from the front face of the base plate 16 and define cylindrical throughbores extending through the base plate 16, the key receptacles 26,28 being laterally aligned with one another on a longitudinal axis LA of the base plate 16.

The slider assembly 18 includes a generally rectangular metal or high impact plastic plate 30 to which a toothed rack 36 is affixed and a slider assembly limit means, such as a resilient locking member 32 attached to the plate 30. The plate 30 includes a home key retaining slot 42 and a visitor key retaining slot 44. The plate 30 is slidably mounted in abutment with the rearward, i.e., interior, face of the base plate 16, and is confined for longitudinal sliding movement by upper and lower bordering walls 15,17 extending rearwardly and longitudinally from the base plate 16. If desired, the plate 30 may be provided with longitudinally extending mounting slots (not shown) through which mounting bolts may be affixed to the base plate to constrain the plate 30 to slide in a longitudinal direction with respect to the base plate 16, i.e., in substantial alignment with the longitudinal axis LA.

Figure 2:
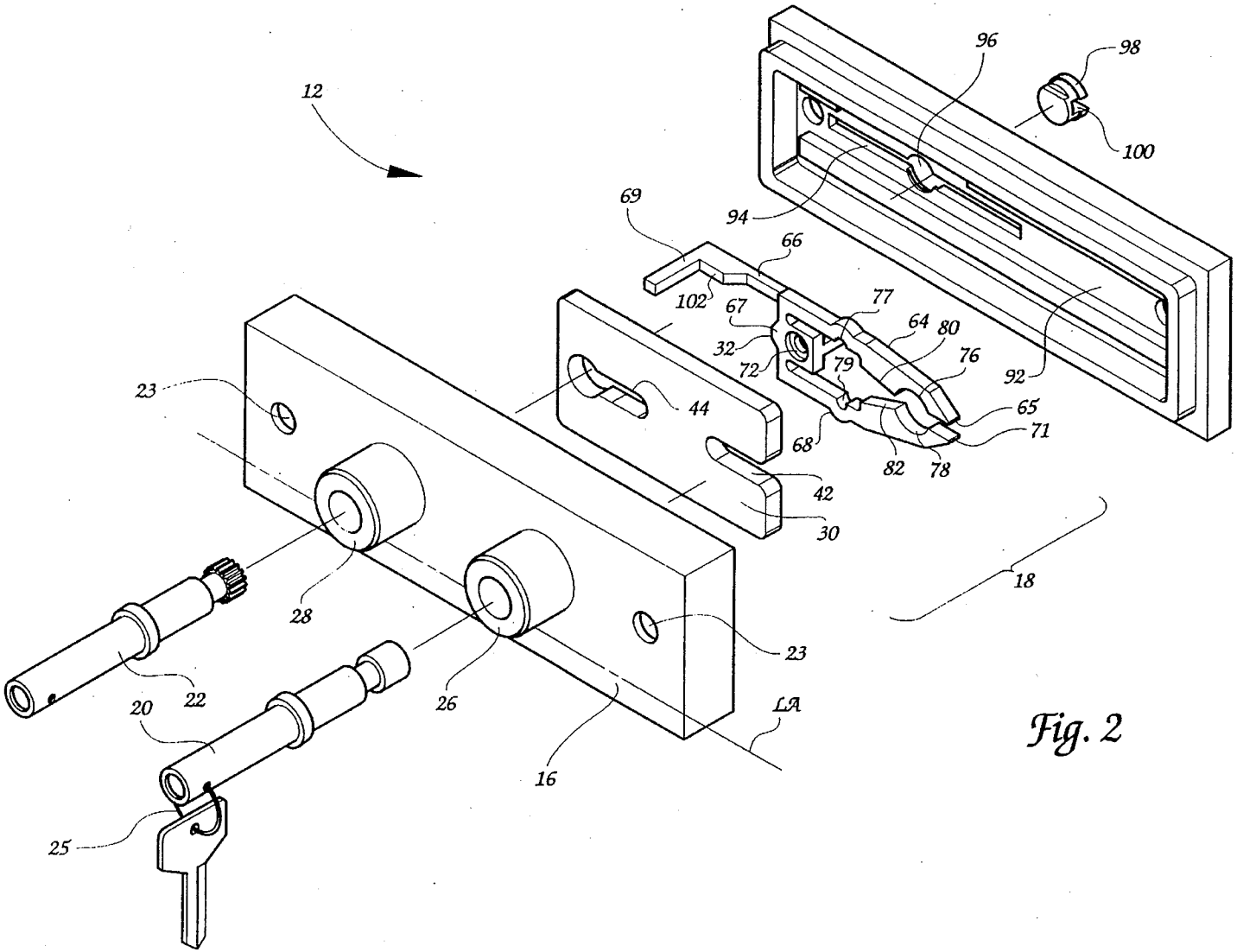
FIG. 2 is an enlarged exploded front perspective view of one unit of the preferred embodiment of the key safe apparatus shown in FIG. 1.
Figure 3:
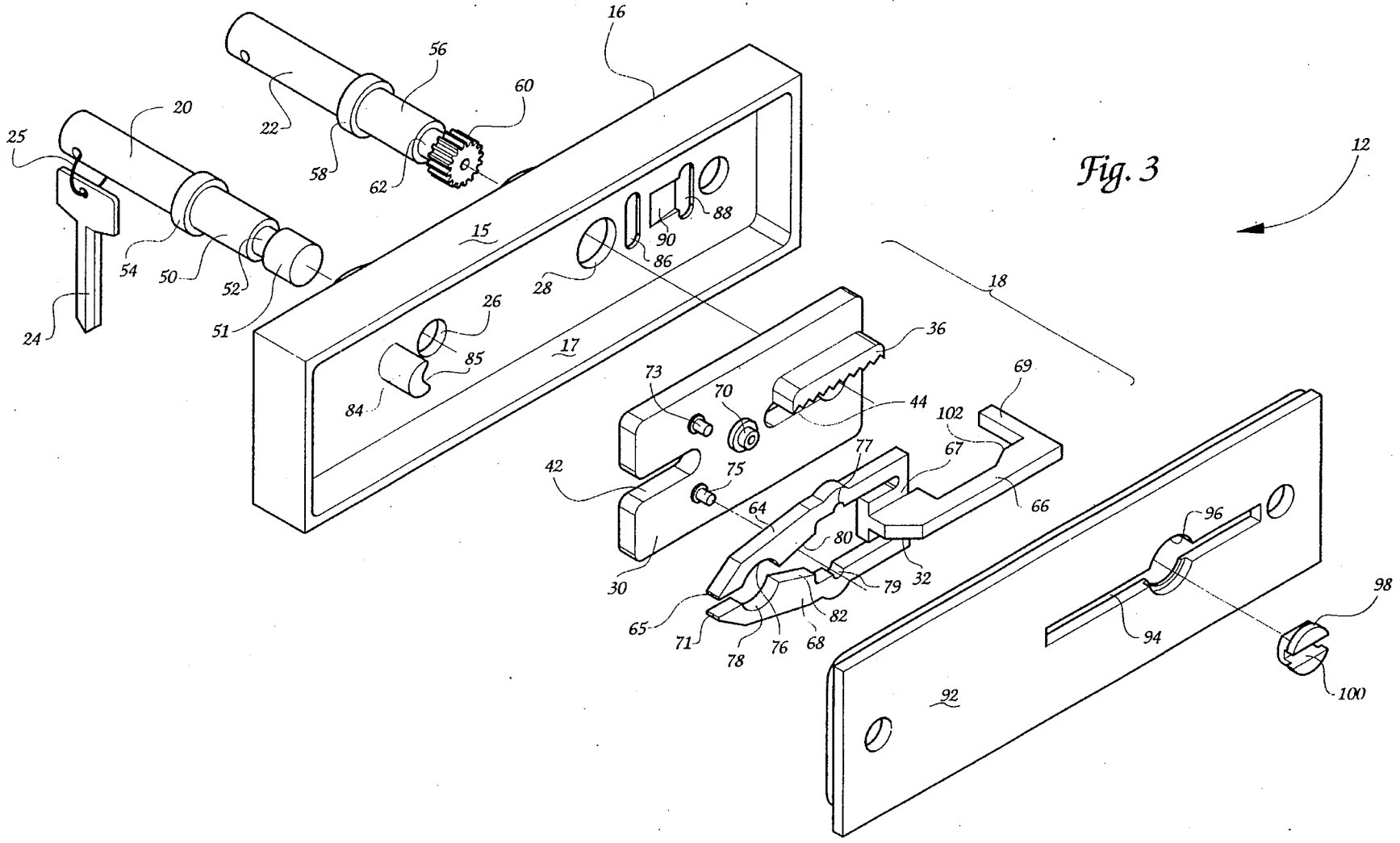
FIG. 3 is an enlarged exploded rear perspective view of the unit of the apparatus shown in FIG. 2.

As best seen in FIGS. 2 and 3, the home key retaining slot 42 is an open ended rectangular slot extending longitudinally of the plate 30 at the end thereof disposed generally inwardly behind the home key receptacle 26. The home key retaining slot 42 is located such that the home key 20 may be received therein during the longitudinal sliding movement of the plate 30 relative to the base plate 16 when the key is inserted in its key receptacle 26. The visitor key retaining slot 44 includes a portion extending longitudinally of the plate 30 of generally uniform lateral extent transversely to its longitudinal extent and a cylindrical portion. The longitudinal portion extends from its one closed end in a direction away from the home key retaining slot 42 toward its other end, which is open and communicated with the cylindrical portion. The cylindrical portion has a diameter greater than the lateral extent of the longitudinal portion. The visitor key retaining slot 44 is located such that the visitor key 22 may be received therein during the entire travel of the plate 30 with respect to the base plate 16 when the visitor key 22 is inserted into its key receptacle 28.

As also seen in FIGS. 2 and 3, the home key 20 includes a cylindrical main body portion 50 having an annular radial shoulder 54 approximately midway along its length and an annular groove 52 formed adjacent the free end of the main body 50 to define a cylindrical retaining portion 51 at the free end. The annular groove 52 has a diameter slightly less than the lateral extent of the home key retaining slot 42 transversely to the longitudinal extent thereof and the cylindrical retaining portion 51 is of a diameter greater than the lateral extent of the home key retaining slot 42.

The spacing of the annular shoulder 54 from the annular groove 52 is selected such that the annular groove 52 is in alignment with the plate 30 when the home key 20 is sufficiently inserted into its key receptacle 26 to bring the annular shoulder 54 into abutment with the hub of the key receptacle 26 at the front face 14 of the cabinet 10. As can be understood, the plate 30 engages the home key 20 in a fork-like manner when the plate is moved such that the annular groove 52 is received in the home key retaining slot 42 (see FIG. 4).

As seen in FIG. 3, the toothed rack 36 is in the form of a conventional linear tooth rack of a rack and pinion gear type assembly and is rigidly fixed by welding, molding or other appropriate securement means to the plate 30 with the teeth thereof extending longitudinally of the plate 30 and cooperatively located in parallel adjacent facing relation to the visitor key retaining slot 44. Specifically, the teeth of the toothed rack 36 are positioned for engagement by the visitor key 22 when the visitor key is inserted into its key receptacle 28. In this regard, the visitor key 22 includes a cylindrical main body portion 56 having an annular shoulder 58 formed approximately midway along its length, and a pinion gear 60 formed at one end thereof, as seen in FIGS. 2 and 3. The pinion gear 60 is spaced from the annular shoulder 58 such that the pinion gear 60 extends slightly beyond the plate 30 for meshing engagement with the rack 36 when the visitor key 22 is inserted in its key receptacle 28 with the annular shoulder 58 in abutment with the hub of the key receptacle 28 at the outer face 14 of the cabinet 10.

An annular groove 62 is formed in the body 56 of the visitor key 22 inwardly of, and adjacent to, the pinion gear 60 and is of a diameter slightly less than the lateral extent of the longitudinal portion of the visitor key retaining slot 44. The outer diameter of the pinion gear 60 and the diameter of the cylindrical portion 56 of the visitor key 22 are each of a diameter slightly greater than the lateral extent of the longitudinal portion of the visitor key retaining slot 44 but less than the diameter of the cylindrical portion of the slot.

As can thus be understood, the pinion gear 60 is adapted to engage the toothed rack 36 in well known meshing rack and pinion manner to effect sliding movement of the plate 30 relative to the base plate 16 upon rotation of the visitor key 22. Accordingly, the toothed rack 36 is positioned on the plate 30 such that the teeth of the pinion gear 60 engage the teeth of the toothed rack 36 when the visitor key 22 is inserted in its key receptacle 28 and through the visitor key retaining slot 44 so that the rack and pinion-type movement can be effected by rotation of the visitor key 22.

The resilient locking member 32 includes a central body 67 from which upper and lower gripping arms 64,68 project outwardly in one direction in spaced facing relation and an elongate arm 66 extends outwardly in the opposite direction with a perpendicular leg 69 projecting from the outer end of the arm 66. The facing surfaces of the upper and lower gripping arms 64,68 are each formed with a semi-cylindrical recess 76,78, respectively, and a profiled travel surface 80,82, respectively, and terminate at converging free ends 65,71 of the gripping arms 66,68. The locking member 32 is preferably molded integrally of a resilient plastic material to lend sufficient resiliency to the gripping arms 64,68 to normally bias the gripping arms toward one another into a relaxed converging disposition and to be yieldingly deflectable outwardly away from one another and, likewise, for resilient deflection of the elongate arm 66, as more fully explained hereinafter.

The resilient locking member 32 is attached and positioned relative to the slide plate 30 by a hub 70 projecting rearwardly from a central location on the slide plate 30 and received matingly in an opening 72 formed in the central body 67 of the locking member 32. In addition, a pair of posts 73,75 project rearwardly from the slide plate 30 at opposite sides of the home key retaining slot 42 and are received in mating recesses 77,79 in the facing surfaces of the gripping arms 66,68 of the locking member 32. In this manner, the posts 73,75 cooperate with the hub 70 to stabilize the mounted disposition of the locking member 32 relative to the slide plate 30. As more fully explained below, the gripping arms 66,68 cooperate with a stop member 84 extending inwardly from the rearward surface of the base plate 16 at a location along the longitudinal axis LA outwardly adjacent the opening through the home key receptacle 26. The stop member 84 is substantially of a cylindrical configuration essentially corresponding in diameter to the retaining portion 51 of the home key 20, with an arcuate recess 85 being formed laterally into the stop member 84 to face the home key receptacle opening and the home key retaining slot 42 in the slide plate 30. The leg portion 69 of the locking member 32 likewise cooperates in a manner more fully described hereinafter with a pair of slot-like recesses 86,88 formed in the inward face of the base plate 16 outwardly adjacent the inward opening of the visitor key receptacle 28 in spaced parallel relation with one another transversely to the longitudinal axis LA, with a tapered ramp portion 90 formed in the inward surface of the base plate 16 bridging between the recessed slots 86,88. The mounted disposition of the resilient locking member 32 on the slide plate 30 disposes the leg 69 in one or the other of the slot-like recesses 86,88, depending upon the sliding disposition of the plate 30 relative to the base plate 16.

Within the cabinet 10, the locking means of each key safe unit 12 is enclosed by a rearward wall 92 which mates with the bordering walls 15,17 of the respective base plate 16, as seen in FIGS. 2 and 3. The rear wall 92 has a longitudinally-extending linear slot 94 formed therethrough coplanarly with the longitudinal axis LA, in which slot 94 the elongate arm 66 of the locking member 32 slides during reciprocating movements of the slider assembly 18. The slot 94 includes a circular enlargement 96 midway along the length of the slot 94, in which a cam disk 98 is retained. The cam disk 98 has a recessed slot 100 formed diametrically through the disk 98 in alignment with the slot 94, the elongate arm 66 of the resilient locking member 32 extending outwardly of the cam disk 98 through its recessed slot 100. The circular enlargement 96 is formed in the rear wall 92 in coaxial alignment with the key receiving opening through the visitor key receptacle 28 for engagement of the inward face of the cam disk 98 by the visitor key 22 upon insertion through its key receptacle 28. A cam lobe 102 projects from the elongate arm 66 of the locking member 32 adjacent the leg 69 for cooperation with the cam disk 98 during sliding movement of the slider assembly 18, as described below.

Figure 4:
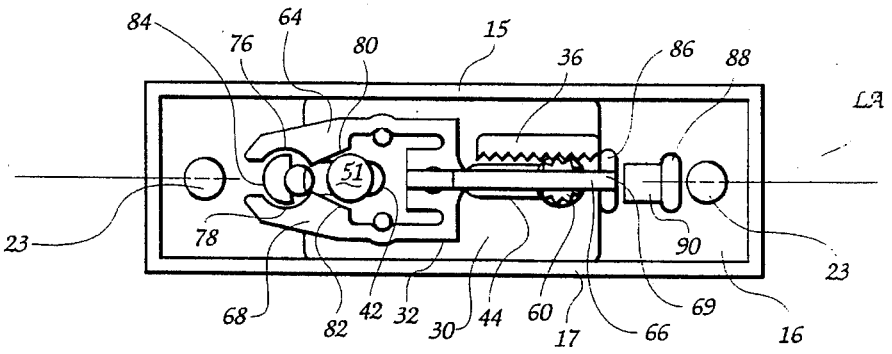
FIG. 4 is an enlarged rear elevational view of the unit shown in FIG. 2, showing the locking means of the apparatus in its first position for locking the home key in its key receptacle.
Figure 5:
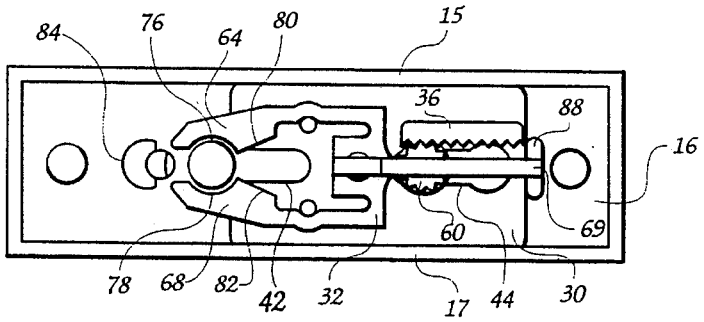
FIG. 5 is an enlarged rear elevational view of the unit shown in FIG. 2, showing the locking means of the apparatus in its second position releasing the home key for removal from its key receptacle and locking the visitor key in its key receptacle.
Figure 6:
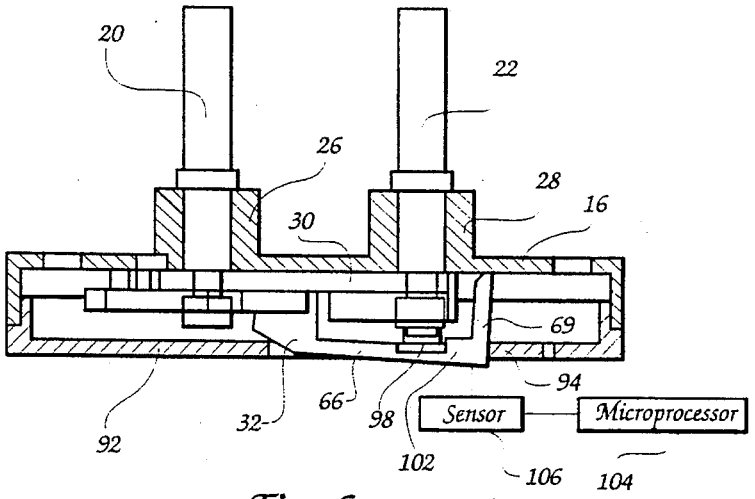
FIG. 6 is a horizontal cross section of the unit shown in FIG. 2, taken along line 6—6 of FIG. 4.

The operation of the key safe apparatus 12 may thus be understood with reference to FIGS. 4–6. As shown in FIG. 4, the home key 20 is normally inserted in its key receptacle 26 and the slide assembly 18 is disposed in a first position locking the home key 20 in its key receptacle 26. Specifically, the plate 30 of the slider member 18 is disposed at its leftmost position (as viewed in FIG. 4) with respect to the base plate 16. In this disposition of the slider assembly 18, the cylindrical portion of the visitor key retaining slot 44 is generally aligned with the visitor key receptacle 28 and the home key retaining slot 42 receives the annular groove 52 of the home key 20 whereby the plate 30 engages the annular groove 52 of the home key 20 in a fork-like manner to prevent release of the key from the key safe apparatus 12. In this first position of the slider assembly 18, the gripping arms 64,68 engage the stop member 84 within their recesses 76,78 with their profiled travel surfaces 80,82 contacting opposite sides of the home key 20, and the leg 69 of the locking member 32 is engaged in the slotted recess 86 most closely adjacent the visitor key receptacle 28. As can thus be understood, the home key 20 cannot be removed from the cabinet 10 since the plate 30 prevents axial movement of the home key 20. At the same time, the locking member 32 effectively prevents sliding movement of the slide plate 30 to release the home key 20. Each of the home keys 20 illustrated in FIG. 1 are normally locked in the cabinet 10 in this manner by the key safe apparatus 12.

If a person desires to remove a selected one of the home keys 20 for use of its particular conventional key 24 secured thereto, the person must possess one copy of the visitor key 22, which are all of identical configuration. The person need only then insert his or her visitor key 22 into the visitor key receptacle 28 of the pair of key receptacles 26,28 associated with the selected home key 20. As seen in FIG. 4, since the cylindrical portion of the visitor key retaining slot 44 is aligned with the visitor key receptacle 28 when the slider member 18 is in its first position in which it locks the home key 20, the visitor key 22 can be fully inserted into the key receptacle 28 until its annular shoulder 58 abuts the outer hub of the receptacle. The complete insertion of the visitor key 22 into its key receptacle 28 also brings the pinion gear 60 thereon into meshing engagement with the toothed rack 36 on the plate 30. At the same time, the end face of the pinion gear 60 engages the cam disk 98 to push it and, in turn, to deflect the cam lobe 102 of the elongate arm 66 of the locking member 32 rearwardly away from the base plate 16, thereby disengaging the leg 69 of the locking member 32 from the recessed slot 86. Accordingly, when the visitor key 22 is thereafter rotated about its axis in a clockwise direction as viewed in FIG. 4, the pinion gear 60, via its driving engagement with the toothed rack 36, moves the slider assembly of the plate 30 and the locking member 32 longitudinally relative to the base plate 16 from the leftward disposition of FIG. 4 in the right-hand direction into a second position shown in FIG. 5.

In the second position of FIG. 5, the slide plate 30 releases the home key 20 for removal from its key receptacle 26 and locks the visitor key 22 in its key receptacle 28, as shown in FIG. 5. Specifically, the plate 30 moves to the right (as viewed in FIG. 5) relative to the base plate 16 and, during this movement, the visitor key retaining slot 44 moves relative to the visitor key 22 and the upper and lower gripping arms 64,68 deflect outwardly by engagement of the travel surfaces 80,82 with the retaining portion 51 of the home key 20 to pivot oppositely away from one another. As the visitor key retaining slot 44 moves relative to the visitor key 22, the longitudinal portion of the slot engages the annular groove 62 of the visitor key, to lock the visitor key with respect to the base plate 16. That is, the interengagement of the plate 30 and the annular groove 62 of the visitor key 22 prevent axial movement, i.e., withdrawal, of the visitor key 22. Thus, the visitor key 22 cannot be removed from its key receptacle 28 when the slider assembly 18 is disposed in its second position.

As the slide plate 30 completes its rightward movement into the second position shown in FIG. 5, the outwardly deflected free ends 65,71 of the gripping arms 64,68 move rightwardly past the stop member 84 as the travel surfaces 80,82 of the gripping arms 64,68 move rightwardly past the retaining portion of the home key 20, thereby allowing the gripping arms 64,68 to relax and move toward one another to dispose the recesses 76,78 of the arms 64,68 in encircling disposition coaxially about the home key retaining portion 51 and coaxial with the key receptacle 26. At the same time, the slide plate 30 clears the annular groove 52 of the home key 20. Since the semi-cylindrical portions 76,78 generally define a cylindrical opening therebetween of a larger diameter than the home key 20, the home key 20 is thus released for removal from its key receptacle 26 and can be withdrawn by the key borrower for use of the conventional key 24 secured thereto. In the second position of FIG. 5, the cam lobe 102 of the elongate arm 66 of the locking member 32 is moved rightwardly from its original disposition directly behind the visitor key receptacle 28 allowing the arm 66 to relax and, in turn, causing the leg 69 of the locking member to engage in the recessed slot 88 to act as a stop to the rightward movement of the slider assembly 18 and thereby position it properly in the second position.

To ensure that the key borrower returns the home key 20 to its key receptacle 26, the key safe apparatus 12 is configured to retain the visitor key 22 in its locked disposition in its key receptacle 28 when the home key 20 is released from its locked position in its key receptacle 26. Specifically, as seen in FIG. 5, attempted counterclockwise rotation of the visitor key 22 produces, via the toothed rack 36, only very limited movement of the plate 30 in a leftward direction with respect to the base plate 16, the leftward movement being opposed and stopped by engagement of the relaxed converging free ends 65,71 of the gripping arms 64,68 into the arcuate recess 85 in the stop member 84 in the absence of the retaining portion 51 of the home key to deflect the arms 64,68 outwardly of the stop member 84. The abutting contact between the ends 65,71 of the arms 64,68 of the locking member 32 and the stop member 84 thereby prevents further leftward movement of the plate 30 relative to the base plate 16 before the plate 30 can travel sufficiently for the plate to move out of engagement with the annular groove 62 of the visitor key 22. Accordingly, when the home key 20 has been removed from its key receptacle 26, the rotation of the visitor key 22 alone is not effective to release the plate 30 from its locking engagement with the annular groove 62 of the visitor key and the key cannot be withdrawn from the cabinet 10. Thus, the key safe apparatus 12 of the present invention ensures that the key borrower's copy of the visitor key 22 is always "relinquished" to permit release of the desired home key 20. If desired, each copy of the visitor key 22 can be tagged or otherwise provided with an identification means so that the identity of the particular copy disposed in a given key receptacle 28 can be noted to determine the identification of the key borrower.

Once the key borrower has completed his or her use of the conventional key 24 of the borrowed home key 20, the home key 20 is reinserted into its key receptacle 26. If the plate 30 has, in the meantime, been moved relative to the base plate 16 since the release of the home key 20 such that the semi-cylindrical portions 76,78 of the gripping arms 64,68 are no longer in exact alignment with the visitor key receptacle 26, the key borrower need only rotate the visitor key 22 until the semi-cylindrical portions 76,78 are again brought into alignment with the home key receptacle 26, thereby permitting the home key 20 to be fully inserted into its key receptacle. To then secure release of his or her copy of the visitor key 22, the key borrower need only rotate the visitor key 22 in a counterclockwise direction to move the slider assembly 18 from its second position shown in FIG. 5 to its first position shown in FIG. 4. During the movement of the slider assembly 18 between its second and first positions, the retaining portion 51 of the inserted home key 20 serves as a wedge or cam means between the gripping arms 64,68 to urge them to deflect outwardly in opposite directions away from one another sufficiently to clear the stop member 84. Simultaneously, the left-hand movement of the plate 30 brings the plate into locking interengagement with the annular groove 52 of the home key 20 as the annular groove 52 is received in the home key retaining slot 42.

The continued counterclockwise rotation of the visitor key 22 eventually moves the plate 30 to the left sufficiently for the slider assembly 18 to reach its first position in which the cylindrical portion of the visitor key retaining slot 44 moves into alignment with the visitor key 22, thus releasing the visitor key 22 for removal from its key receptacle 28.

As can best be seen in FIG. 6, with the home key received and locked in its key receptacle 26 by the disposition of the slide assembly 18 in its first position (see also FIG. 4), the stationary mounted disposition of the cam disk 98 within the rear wall 92 directly behind the visitor key receptacle 28 positions the cam disk 98 in covering relation to a portion of the elongate arm 66 of the locking member 32, i.e., between the visitor key receptacle 28 and the arm 66. In this manner, the cam disk 98 prevents a foreign object (e.g., a screwdriver, writing pen, etc.) inserted through the visitor key receptacle 28 from being utilized to attempt to manipulate the locking member 32 to circumvent the locking function of the slider assembly 18. More specifically, upon insertion of any such foreign object, the object encounters the cam disk 98 without making direct contact with the elongate arm 66 and, thus, the object cannot actuate sliding movement of the locking element 32. Thus, the stationary disposition of the cam disk 98 in covering relation to the arm 66 prevents the present device from being "picked" or other unauthorized unlocking of the device without use of a visitor key 22.

The key safe apparatus 12 of the present invention thus advantageously provides an apparatus for alternately locking a selected one of a pair of keys and releasing the other key for removal from the apparatus. Accountability for borrowed keys can be maintained since a key borrower must relinquish possession of his or her copy of the visitor key to effect removal of the home key. Likewise, the key borrower cannot regain possession of his or her copy of the visitor key until the borrowed home key has been returned to, and locked in, the key safe apparatus.

In furtherance of the foregoing purposes and advantages of the present invention, the disposition of the deflectable elongate arm 66 within the slot 94 in the rear wall 92 of the apparatus together with the provision of the cam lobe 102 in cooperation with the cam disk 98 disposed in the slot 94 necessarily causes the arm 66 to be deflected rearwardly to project from the slot 94 each time a visitor key 22 is inserted into the key receptacle 28 to remove the home key 20 and, again, each time the home key is returned and the slider assembly 18 is operated by the visitor key 22 for its removal, as depicted in FIG. 6. Accordingly, it is contemplated that the cabinet 10 may be equipped interiorly with a computerized or other form of electronic means, indicated only representatively at 104, for monitoring and recording each removal and return of each home key, the actual clock time of the key removal and return, the elapsed time in each case, etc., by providing appropriate sensors, indicated only representatively at 106, to recognize each outward deflection of the elongate arm 66 of each key safe unit. In this manner, the operator of the cabinet 10 is further enabled to better monitor the use of the various home keys, the frequency of such use on an individual and collective basis, and to compare the usage of each home key against others, all to better supervise the inventoried items controlled by the conventional keys attached to the home keys.

It will therefore be readily understood by those persons skilled in the art that the present invention is susceptible of a broad utility and application., Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention.

The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for alternately locking a selected one of a pair of keys and releasing the other key for removal from the device, the device comprising:

a home key normally locked in the device;

a visitor key normally not locked in the device;

lock base means defining a pair of key receptacles, one key receptacle for receiving the home key and the other key receptacle for receiving the visitor key; and locking means movable relative to the lock base means between a first position locking the home key in its key receptacle and a second position releasing the home key for removal from its key receptacle, the locking means including a slider assembly movably mounted to the lock base means for reciprocating movement transversely to the key receptacles by the visitor key when received in its key receptacle and for executing a detectible movement away from the lock base means during a reciprocating movement of the slider assembly for removing the home key and means for detecting each detectable movement of the slider assembly to enable monitoring of each removal and replacement of the home key.

2. A device according to claim 1 and further comprising cam means for causing a portion of the slider assembly to move toward and away from the lock base means in relation to reciprocating movements of the slider assembly.

3. A device according to claim 2, wherein the cam means comprises a bearing surface and a profiled cam surface on the slider assembly for movement in engagement with the bearing surface during reciprocating movements of the slider assembly.

4. A device according to claim 3, wherein the slider assembly includes an arm portion having the profiled cam surface thereon for movement of the arm portion toward and away from the lock base means.

5. A device according to claim 1 and further comprising means associated with the detecting means for storing information concerning the detected movements.

6. A device according to claim 1, wherein a portion of the slider assembly is disposed adjacent the visitor key receptacle to be deflected away from the lock base means upon insertion of the visitor key in its key receptacle.

7. A device according to claim 6, wherein the slider assembly portion comprises a resiliently deflectable arm portion.

8. A device according to claim 1, wherein the visitor key includes a gear portion and the slider assembly includes a toothed rack for meshing engagement with the gear portion of the visitor key when inserted into its key receptacle for actuation of reciprocating movements of the slider assembly by rotation of the visitor key.

9. A device for alternately locking a selected one of a pair of keys and releasing the other key for removal from the device, the device comprising:

a home key normally locked in the device;

a visitor key normally not locked in the device;

lock base means defining a pair of key receptacles, one key receptacle for receiving the home key and the other key receptacle for receiving the visitor key;

locking means movable relative to the lock base means between a first position locking the home key in its key receptacle and a second position releasing the home key for removal from its key receptacle, the locking means including a slider assembly movably mounted to the lock base means for reciprocating movement transversely to the key receptacles by the visitor key when received in its key receptacle;

a projecting stop member and first and second stop recesses formed on the lock base means at spacings from one another generally along the extent of reciprocating movement of the slider assembly;

the slider assembly including a resilient locking member having a pair of engagement elements resiliently movable toward and away from one another, a locking leg portion spaced from the engagement elements, a connecting arm portion extending therebetween; and the engagement elements and the locking leg portion of the locking member and the stop member and stop recesses on the lock base means being cooperatively arranged (a) for gripping engagement by the engagement elements in opposition to one another about the stop member and engagement of the locking leg portion in the first stop recess when the locking means is in its first position with the home key received in its key receptacle, thereby to prevent movement of the locking means to its second position without insertion of the visitor key into its key receptacle, and (b) for abutment of the engagement elements with a common side surface of the stop member and engagement of the locking leg portion in the second stop recess when the locking means is in its second position with the home key removed from its key receptacle, thereby to prevent movement of the locking means to its first position without return of the home key into its key receptacle.

10. A device according to claim 9, wherein the connecting arm portion of the locking member is disposed adjacent the visitor key receptacle to be deflected away from the lock base means upon insertion of the visitor key in its key receptacle for displacing the locking leg portion out of the first stop recess to enable movement of the locking means from the first position to the second position.

11. A device according to claim 9, wherein the engagement elements of the locking member include cam portions for engagement with the home key when in its key receptacle to expand the engagement elements away from one another during movement of the slider assembly by the visitor key to disengage the engagement elements from the stop member for movement of the locking means between the first and second positions.

12. A device according to claim 9 and further comprising a ramp surface connecting the first and second stop recesses for sliding movement of the locking leg portion from the second stop recess into the first stop recess during movement of the locking means from the second position into the first position.

13. A device according to claim 9, wherein the visitor key includes a gear portion and the slider assembly includes a toothed rack for meshing engagement with the gear portion of the visitor key when inserted into its key receptacle for actuation of reciprocating movements of the slider assembly by rotation of the visitor key.

14. A device according to claim 9 wherein the slider assembly is arranged for executing a detectible movement away from the lock base means during a reciprocating movement of the slider assembly for removing the home key to enable monitoring of each removal and replacement of the home key.

15. A device for alternately locking a selected one of a pair of keys and releasing the other key for removal from the device, the device comprising:

a home key normally locked in the device;

a visitor key normally not locked in the device, the visitor key including a gear portion;

lock base means defining a pair of key receptacles, one key receptacle for receiving the home key and the other key receptacle for receiving the visitor key; and locking means movable relative to the lock base means between a first position locking the home key in its key receptacle and a second position releasing the home key for removal from its key receptacle, the locking means including a slider assembly movably mounted to the lock base means for reciprocating movement transversely to the key receptacles by the visitor key when received in its key receptacle and for executing a detectible movement away from the lock base means during a reciprocating movement of the slider assembly for removing the home key to enable monitoring of each removal and replacement of the home key, the slider assembly including a toothed rack for meshing engagement with the gear portion of the visitor key when inserted into its key receptacle for actuation of reciprocating movements of the slider assembly by rotation of the visitor key.

* * * * *